United States Patent [19]

Fields

[11] Patent Number: 5,029,523

[45] Date of Patent: Jul. 9, 1991

[54] APPARATUS FOR, AND A METHOD OF, PRINTING A PATTERN ON A CONTAINER COMPONENT

[75] Inventor: Brian Fields, Cirencester, England

[73] Assignee: CMB Foodcan plc, England

[21] Appl. No.: 484,953

[22] Filed: Feb. 26, 1990

[30] Foreign Application Priority Data

Mar. 2, 1989 [GB] United Kingdom ..... 8904819

[51] Int. Cl.[5] ..... B41F 17/26

[52] U.S. Cl. ..... 101/40.1; 101/483

[58] Field of Search ..... 101/38.1, 39, 40, 40.1, 101/35, 4, 124, 483, 484, 485; 400/48, 128

[56] References Cited

U.S. PATENT DOCUMENTS

| | | | |
|---|---|---|---|
| 2,484,671 | 10/1949 | Bauman | 101/124 X |
| 2,881,699 | 4/1959 | Hakogi | 101/39 X |
| 3,521,558 | 7/1970 | Fisher | 101/115 |
| 3,955,495 | 5/1976 | Kammann | 101/40.1 |
| 3,962,970 | 6/1976 | Tielrooy | 101/40.1 |
| 3,975,740 | 8/1976 | Distler et al. | 346/75 |
| 4,461,587 | 7/1984 | Schottle | 400/48 X |

FOREIGN PATENT DOCUMENTS

| | | | |
|---|---|---|---|
| 0088630 | 9/1983 | European Pat. Off. . | |
| 0108683 | 5/1984 | European Pat. Off. . | |
| 0170035 | 2/1986 | European Pat. Off. . | |
| 0209896 | 1/1987 | European Pat. Off. . | |
| 0285680 | 10/1988 | European Pat. Off. . | |
| 3437171 | 4/1986 | Fed. Rep. of Germany | 101/4 |
| 3609619 | 9/1987 | Fed. Rep. of Germany | 101/38.1 |
| 180195A | 3/1987 | United Kingdom . | |

*Primary Examiner*—Clifford D. Crowder

*Attorney, Agent, or Firm*—Diller, Ramik & Wight

[57] ABSTRACT

A printing apparatus for printing a pattern on an endless side wall of a container component comprises six handling mechanisms 13 mounted on an indexing table 11, four printing heads 10 located at spaced apart positions on the indexing table 11, and a carrier 12 associated with each handling mechanism and arranged to carry a container 1 on which a pattern is to be printed. Each handling mechanism 13 comprises an outer roller 26 driven by a motor 20 and an inner roller 32. Each carrier 12 has an endless wall part 35 having a profile which matches that of the side wall of the container and a support part 38,39 for holding a container 1 on which a pattern is to be printed. The endless wall part is held in the nip between roller 26,32. A sensor 41 and an encoder 45 are provided for detecting the position of carrier 12. During operation, the endless wall part 35 is driven between rollers 26,32, thus causing the side wall of the container to pass in front of a printing head 10 with a constant clearance therebetween. The printing head 10 is operated so as to print a pattern in a desired position. An alternative arrangement is described for the handling mechanism 13 and the carrier 12.

11 Claims, 8 Drawing Sheets

APPARATUS FOR, AND A METHOD OF, PRINTING A PATTERN ON A CONTAINER COMPONENT

BACKGROUND OF THE INVENTION

This invention relates to an apparatus for, and a method of, printing a pattern on a container component of one of the types used in the packaging industry.

In the packaging industry, impact printing is the most commonly used technique for printing patterns on the walls of container components. An impact printing apparatus includes a plate for the pattern which is to be printed and a handling system for bringing the ink from the plate into contact with each container component in turn. Where it is desired to change the pattern, the plate must be changed. Where the shape of the container component is changed, corresponding changes must be made in the handling system. Consequently, such an apparatus suffers from the problem that there is a substantial downtime in the usage of the machine.

It is accordingly an object of this invention to provide a new or improved apparatus for, and a method of, printing a pattern on a container component in which the above mentioned problem is overcome or reduced.

SUMMARY OF THE INVENTION

According to one aspect of invention, there is provided an apparatus for printing a pattern on a container component having an endless wall, said endless wall having a non-circular profile, said apparatus comprising a non-contact printing head which remains stationary during printing, a carrier for supporting a container, a handling mechanism for moving the carrier so that at least a curvilinear portion of said endless wall passes in front of the printing head while maintaining a substantially constant clearance between the printing head and said endless wall, and means for operating the printing head so as to cause a desired pattern to be printed on said endless wall.

With the apparatus of this invention, the pattern may be changed simply by re-programming the operating means for the printing head and such re-programming can be achieved with minimal downtime. As printing is achieved with a non-contact printing head, there is no requirement to hold the container wall against a plate during printing. Consequently, the time which is necessary to adapt the apparatus from use with containers of one shape to those of another shape is minimal.

According to another aspect of this invention, there is provided an apparatus for printing a pattern on a container component having an endless wall, said apparatus comprising a non-contact printing head which remains stationary during printing, a carrier for supporting a container, a handling mechanism for moving the container, and means for operating the printing head so as to cause a desired pattern to be printed on said endless wall, in which the carrier comprises an endless wall part having a profile matching that of said endless wall of the container component and a support part for supporting the container component, and the handling mechanism comprises a pair of rollers mounted to form a nip therebetween and means for rotating at least one of said rollers, the wall part of the carrier being held, in use, in said nip.

According to a further aspect of this invention, there is provided a method of printing a pattern on a container component having an endless wall with a non-contact printing head, said endless wall having a non-circular profile, said method comprising the steps of: supporting a container component on a carrier, moving the carrier so that at least a curvilinear portion of said endless wall passes in front of the printing head while maintaining a substantially constant clearance between the printing head and said endless wall, and operating the printing head so as to cause a desired pattern to be printed on said endless wall.

According to a still further aspect of this invention, there is provided a method of printing a pattern on a container component having an endless wall with a non-contact printing head, said method comprising the steps of: supporting a container component on a carrier, the carrier having an endless wall part having a profile matching that of said endless wall of the container component and a support part for supporting the container, holding the wall part of the carrier in a nip between a pair of rollers, rotating at least one of the rollers so as to cause at least a portion of said endless wall of the container component to pass in front of the printing head with a clearance between the printing head and said endless wall, and operating the printing head so as to cause a desired pattern to be printed on said endless wall.

This invention will now be described in more detail, by way of example, with reference to the drawings in which:

DESCRIPTION OF THE PREFERRED EMBODIMENTS

Figure 1:
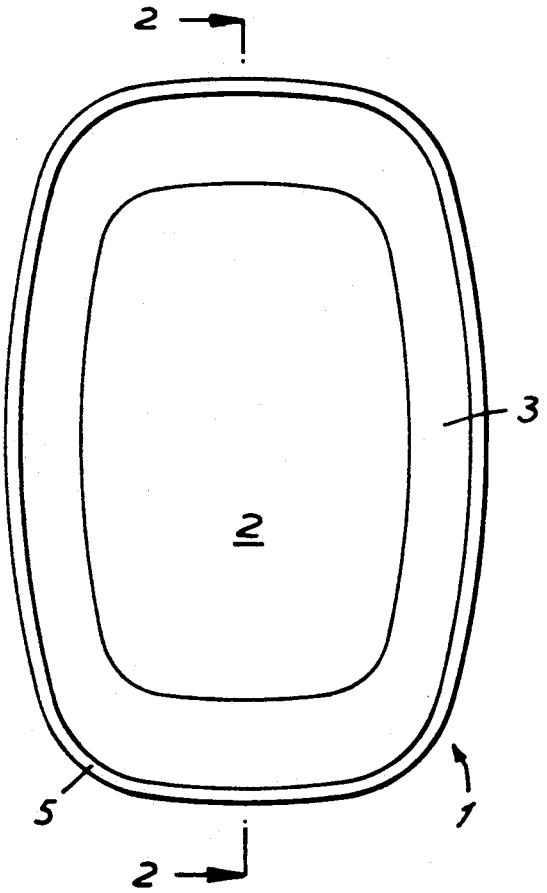
FIG. 1 is a plan view of a container having an endless wall.
Figure 2:
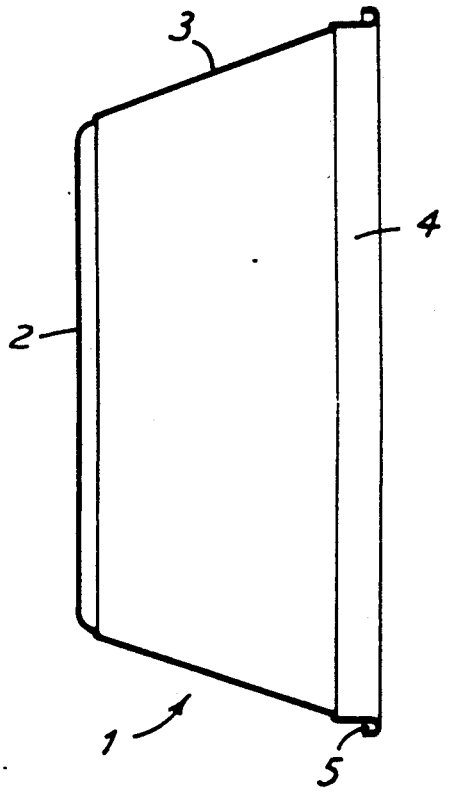
FIG. 2 is a cross-sectional view taken on the line 2—2 of FIG. 1.

Referring to FIGS. 1 and 2, there is shown a container component in the form of a container 1 of the type widely used for packaging margarine. The container 1 comprises a generally planar bottom part 2, an endless side wall 3 extending from the bottom part 2, a flange part 4 extending from the side wall 3, and a curled part 5 extending from the flange part 4. The side wall 3 is tapered between the flange part 4 and the bottom 2. Both the side wall 3 and the flange part 4 have a profile corresponding to a rectangle having curved sides and curved corners.

There will now be described two printing apparatuses which are suitable for printing patterns with non-contact printing heads on the endless side walls of containers. These printing apparatuses will be described mainly with reference to the container 1 shown in FIGS. 1 and 2. However, they are also suitable for use with other types of container. As will become apparent from the following description, each printing apparatus has a set of assemblies and each assembly is arranged to move the endless wall of a container past a printing head with a small but constant clearance between the printing head and the wall.

Figure 3:
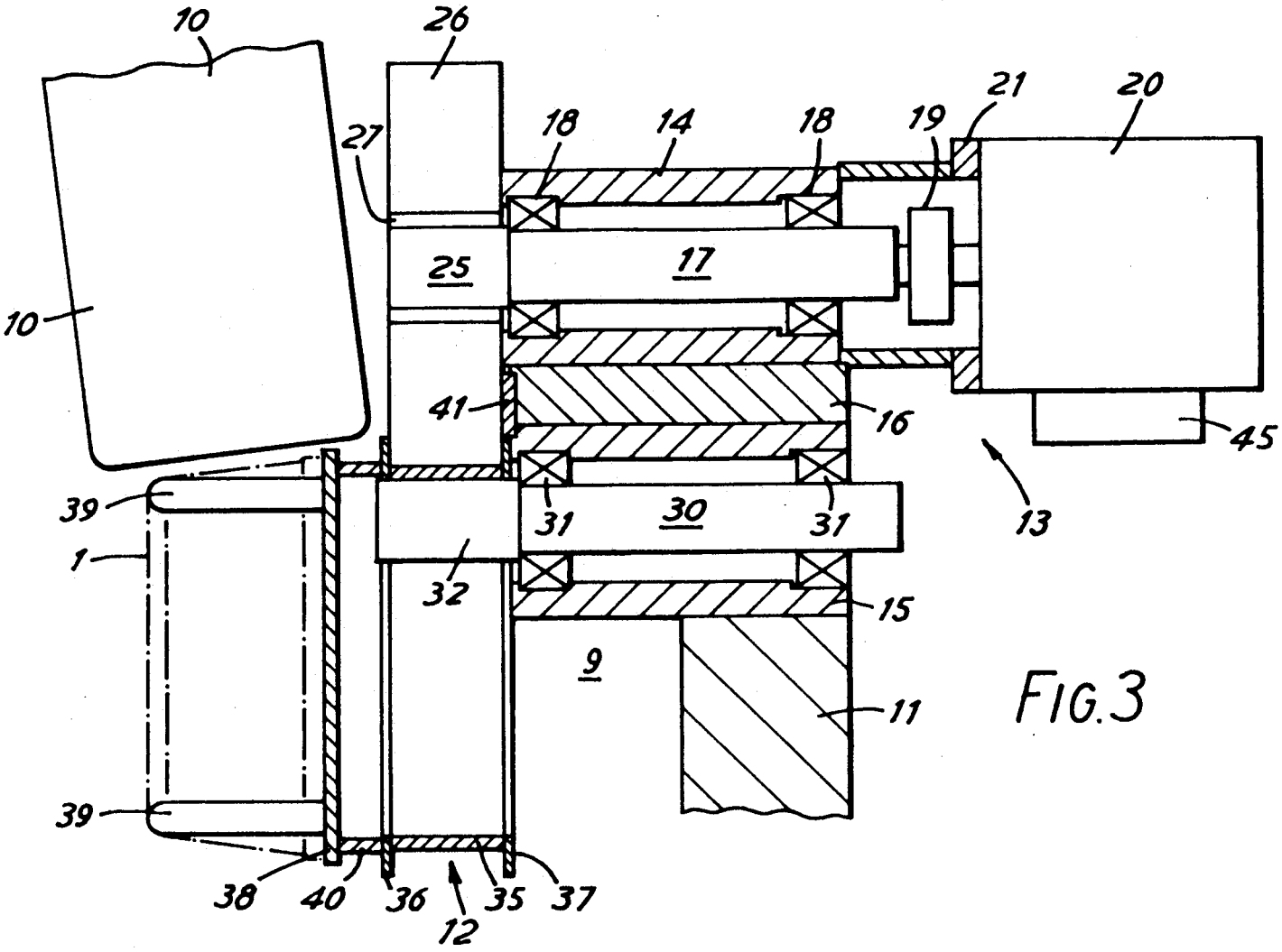
FIG. 3 is a cross-sectional view of an assembly and a printing head forming part of a printing apparatus according to a first embodiment of this invention.

Referring now to FIG. 3, there is shown an assembly 9 and a non-contact printing head 10 forming part of the first printing apparatus. The first printing apparatus includes an indexing table 11, only a fragment of which is shown in FIG. 3. The assembly 9 comprises a carrier 12 for supporting a container 1 and a handling mechanism 13 for the carrier 12.

The handling mechanism includes a pair of bearing housings 14, 15 separated by a spacer 16 and mounted on the indexing table 11. A shaft 17 is rotatably mounted in housing 14 by a pair of bearings 18. As viewed in FIG. 3, the right hand end of shaft 17 is connected by a coupling 19 to the output shaft of an electric motor 20. The motor 20 is itself mounted on housing 14 by a support part 21.

The motor 20 is a type SE568 servomotor manufactured by Mavilor, Zurich, Switzerland. The motor 20 has an integral gearbox. The gearbox is a type RPS/VI gearbox manufactured by Ratiodyn, Wiesloch, German Federal Republic. The motor 20 is provided with a position encoder 45 which detects the rotary position of its output shaft. The position encoder 45 is a type ROD426E position encoder manufactured by Heidenheim, Traunreut, German Federal Republic.

A hub 25 is secured to the left hand end of shaft 17 and a steel outer roller 26 is secured to hub 25 by a mounting ring 27. A set of apertures is formed in roller 26 in order to reduce its moment of inertia. Alternatively, the roller 26 may be made from titanium and coated with resilient material, for example, rubber.

A shaft 30 is rotatably mounted in housing 15 by a pair of bearings 31. An inner roller 32 is secured to the left hand end of shaft 30. The roller 32 is formed from a lightweight material such as titanium and is coated with rubber.

The inner and outer rollers 32, 36 are mounted so that their axes are parallel and so that there is a small clearance or nip between their peripheries.

The carrier has an endless wall part 35, which has a profile matching that of the endless side wall 3 of container 1 at its mid-position. The endless wall part 35 is held between a pair of flanges 36, 37. The endless wall wall 35 is held in the nip between rollers 26, 32 and the flanges 36, 37 prevent the carrier 12 from moving axially. The carrier 12 also has a support part comprising a support plate 38 and four locking bars mounted on support plate 38. Only two of the locking bars are shown in FIG. 3 and these are designated by reference numeral 39. Support plate 38 is connected to flange 36 by a collar 40. In operation, a container 1 is held on support plate 38 by locking bars 39 and the position occupied by the container 1 is shown in phantom outline. A suction device may be provided on support plate 38 to assist in holding a container 1 in position.

In the present example, the non-contact printing head 10 takes the form of an inkjet printing head. As is well known, in an inkjet printing head there are provided a row of ink dispensing nozzles, each of which receives a supply of ink. The printing head 10 is located so that there is a small clearance between it and the endless wall of a container 1 mounted on carrier 12.

The assembly 9 also includes a position sensor 41 located adjacent the periphery of flange 37. The sensor 41 comprises a photo-detector, such as a phototransistor. A single position marker, such as a black line, is provided at a reference position on the periphery of flange 37 and the passage of this marker past sensor 41 is detected by the photo-detector. Thus, the outputs of position encoder 41 and position encoder 45 together provide an indication of the position of carrier 12.

The position sensor 41 together with position encoder 49 represent only one possibility for detecting the position of carrier 12. By way of alternative, a small wheel may be made to run on carrier 12 at a position in line with the nip between rollers 26, 32 and the position of the carrier 12 may then be detected by a rotary encoder placed on the small wheel.

Figure 4:
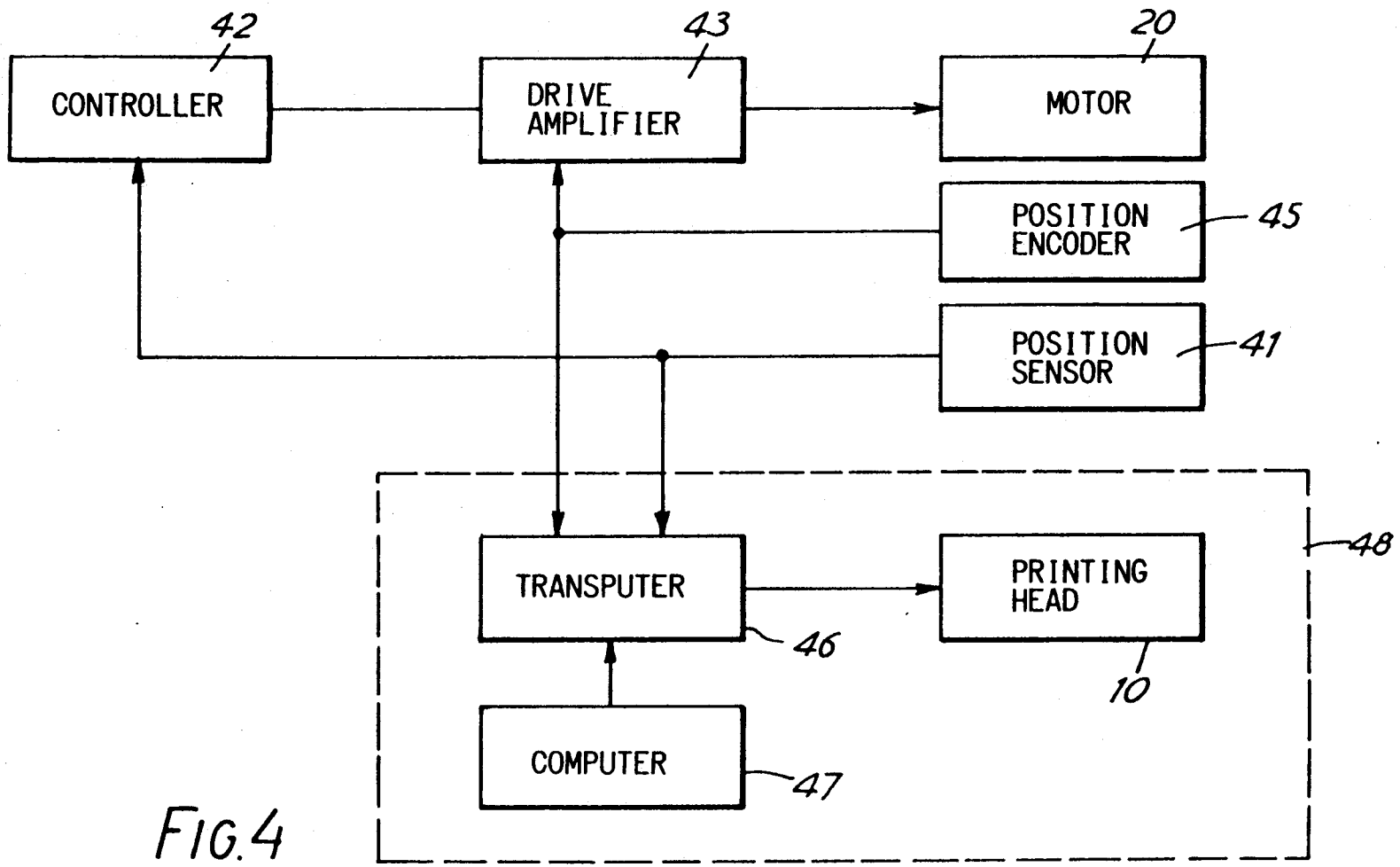
FIG. 4 is a block diagram of a control system for the assembly and printing head of FIG. 3.

Referring now to FIG. 4, there is shown a block diagram of the control system for the assembly 9 and the printing head 10. The control system includes a controller 42 and a drive amplifier 43 which are connected together by a signal line bus. The output of the drive amplifier is connected to motor 20 by a power line bus. The controller 42 is a type DSC-2 intelligent controller manufactured by Quin systems, Lutterworth, Leicestershire, England. The drive amplifier 43 is a type 220/10 drive amplifier manufactured by Infranor, Horsham, Sussex, England.

The output signal from the position sensor 41 is connected to an input of controller 42 and the output of position encoder 45 is connected to an input of drive amplifier 43.

The control system also includes a transputer 46 and computer 47 connected together by a signal line bus. The transputer 46 is connected to the printing head 10 by a signal line bus. The transputer 46 controls the printing head 10 so as to cause it to print a desired pattern. The computer 47 provides the transputer 46 with the data for printing a desired pattern. As indicated by dashed line 48, the printing head 10, transputer 46 and computer 47 together form a type P4-25 inkjet printing system manufactured by Elm Jet Limited, Barr Hill, Cambridge, England.

The assembly 9 and printing head 10 are operated as follows with a container 1 located on carrier 12. The controller 42 causes the motor 20, and hence roller 26, to rotate. As roller 26 rotates, the endless wall part 35 of carrier 12 is driven through the nip between rollers 26 and 32. The controller 42 is programmed to reduce the rotational speed of the motor 20 as the corners of container 1 pass through the nip between rollers 26 and 32. Because the profile of endless wall part 35 matches that of the endless wall of container 1, the clearance between the wall of container 1 and the printing head 10 is maintained constant as the endless wall passes in front of the printing head 10. The endless wall of the container 1 also remains perpendicular to the longitudinal axis of printing head 10. Using the input signal from the position sensor 41 and the position encoder 45, the transputer 46 causes the printing head 10 to print a pattern on the side wall of the container 1 at a desired position.

When it is desired to change the pattern, this is achieved by making the computer 47 change the program in transputer 46. Such a change may be achieved with negligible downtime. When it is desired to use the printing apparatus to print patterns on endless walls of containers of a different type, this is achieved by changing the carrier 12 and such a change may be achieved with minimal downtime. When changing the carrier 12, there is usually no need to alter the position of printing head 10.

If desired, the housing 15 may be slidably mounted on indexing table 11 and a pneumatically operated piston and cylinder may be provided for retracting housing 15, and hence roller 32, to a position where the carrier can be changed.

The handling mechanism 13 shown in FIG. 3 is suitable for use both with container components having non-circular side walls, such as container 1, and also with container components having a circular side wall. An example of a container component with a circular side wall is the dome-shaped member which joints the mounting cup to the body of an aerosol container. When used with a container component having a circular side wall, there is used a carrier having a circular side wall part.

Figure 5:
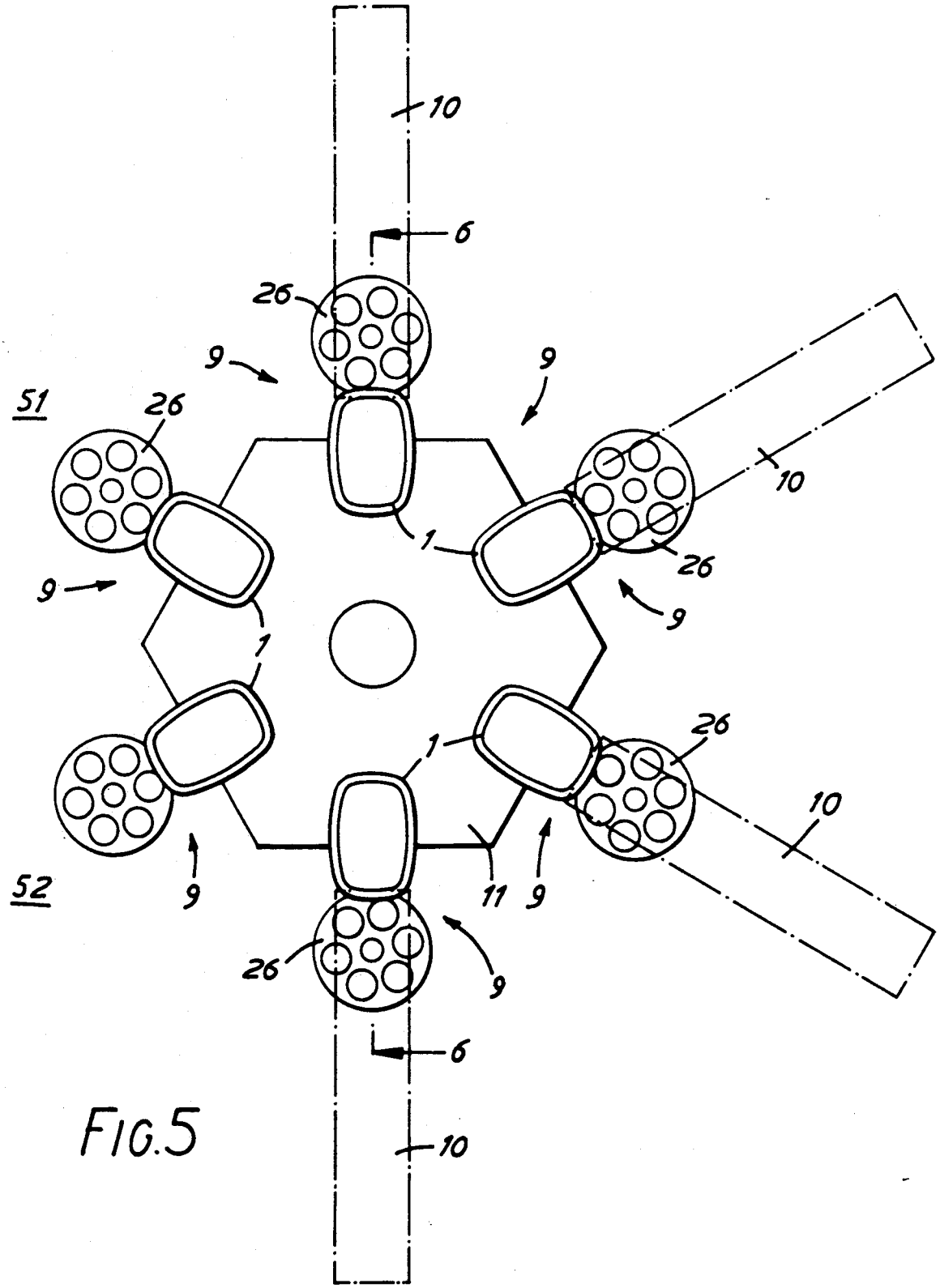
FIG. 5 is a plan view of the printing apparatus of FIG. 3.
Figure 6:
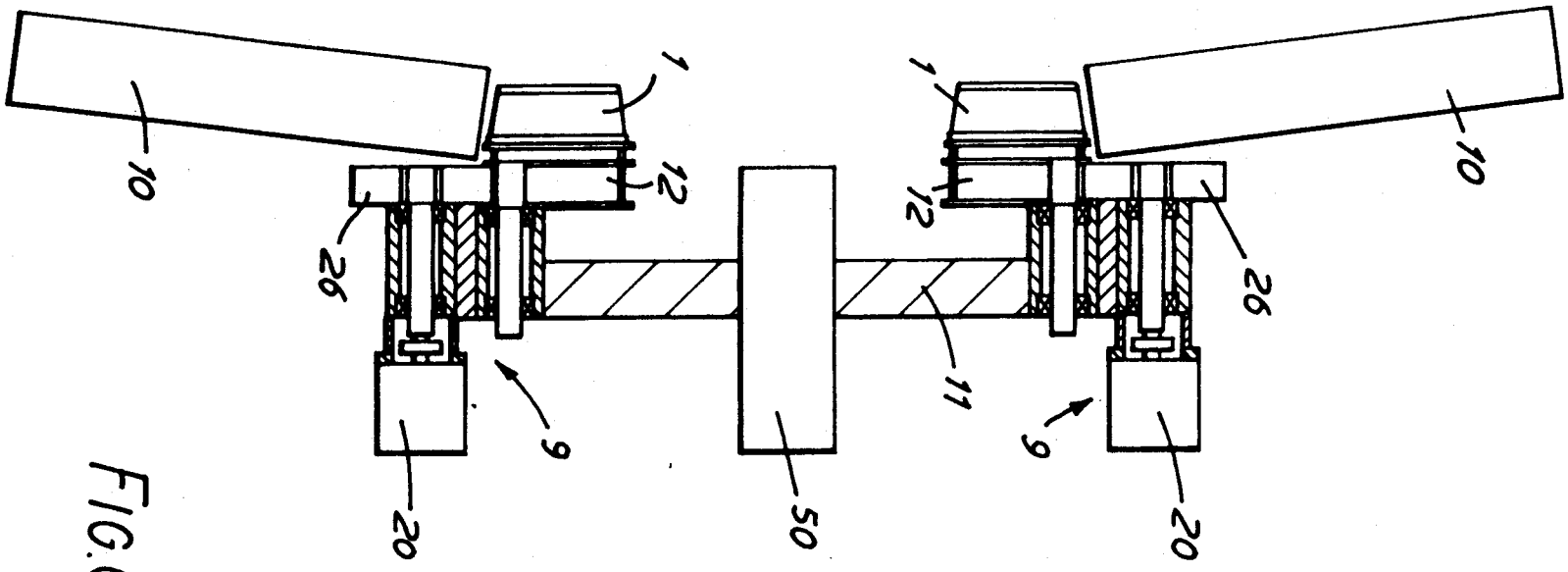
FIG. 6 is a cross-sectional view taken on the line 6—6 of FIG. 5.

Referring now to FIGS. 5 and 6, there are shown plan and cross-sectional views of the printing apparatus, only part of which has been described so far with reference to FIGS. 3 and 4. The printing apparatus comprises six assemblies, each of which is identical to assembly 9 of FIG. 3 and each of which is identified by reference numeral 9. The assemblies 9 are mounted at spaced apart positions on indexing table 11 and indexing table 11 is mounted on a shaft 50 driven by a stepping motor, not shown. In FIGS. 5 and 6, each assembly 9 has a container 1 mounted thereon. The printing apparatus also includes four printing heads located at spaced apart positions around table 11. Each of these printing heads is identical to the head 10 of FIG. 3 and each printing head is indicated by the numeral 10. Each printing head 10 is provided with its own colour of ink. Thus, the printing apparatus is capable of printing patterns in four different colours. The printing apparatus includes a loading station 51 and an unloading station 52. The details of stations 51 and 52 are not shown as they would be well known to a man skilled in the art.

In operation, containers 1 are loaded onto the assemblies 9 at loading station 51. The containers 1 are then conveyed, in series, to each printing head 10 in turn and are unloaded at unloading station 52. At each printing head 10, a pattern is printed on each container, in turn, in ink of the colour supplied to that printing head.

By way of modification, the printing heads 10 may be mounted in line and the assemblies 9 conveyed to each printing head in turn by a linear conveyor.

When it is desired to print a pattern on containers in only one colour, this may be achieved with a single assembly 9 and a single printing head 10 and the indexing table 11 is not required.

Figure 7:
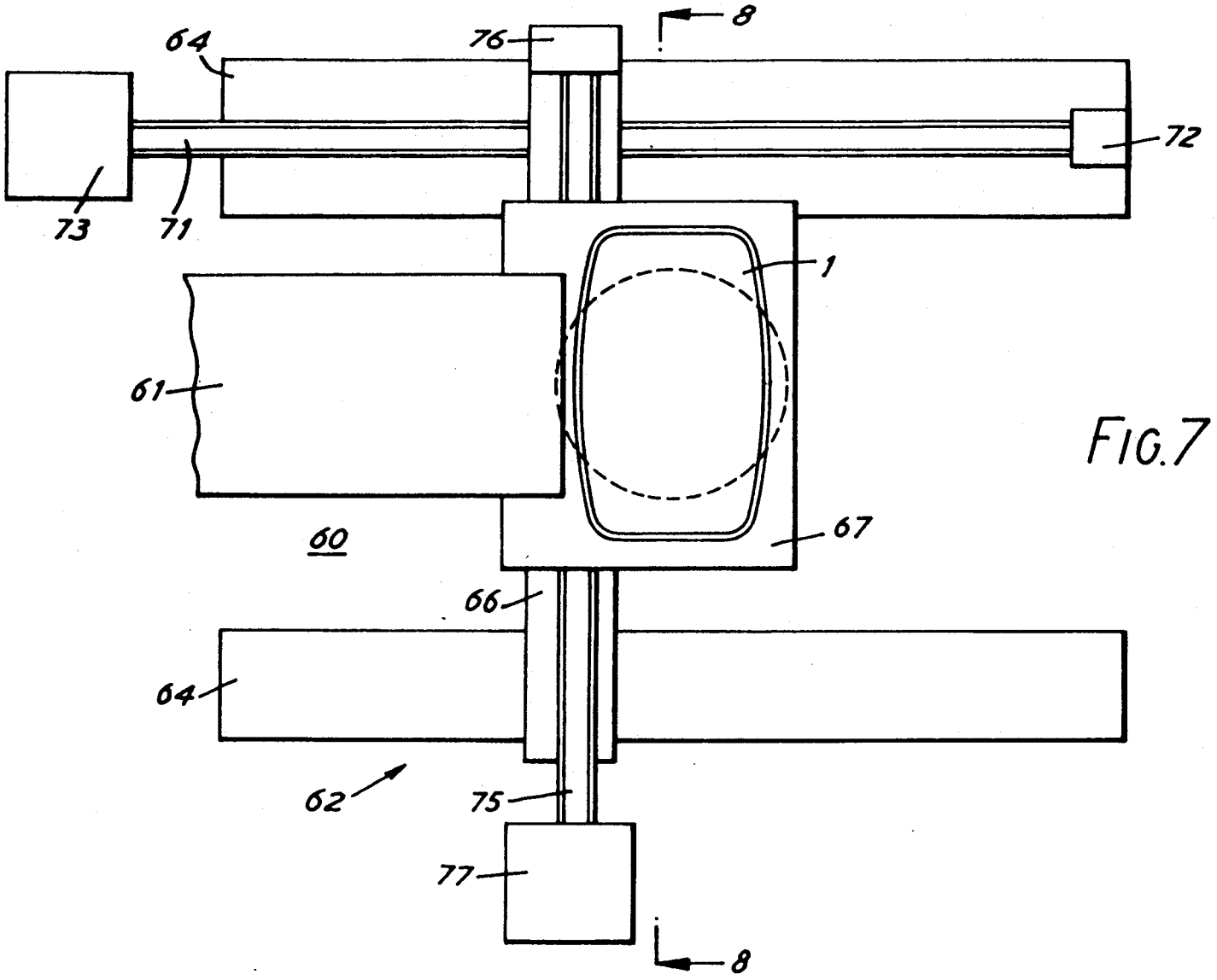
FIG. 7 is a plan view of an assembly and printing head forming part of a printing apparatus according to a second embodiment of this invention.
Figure 8:
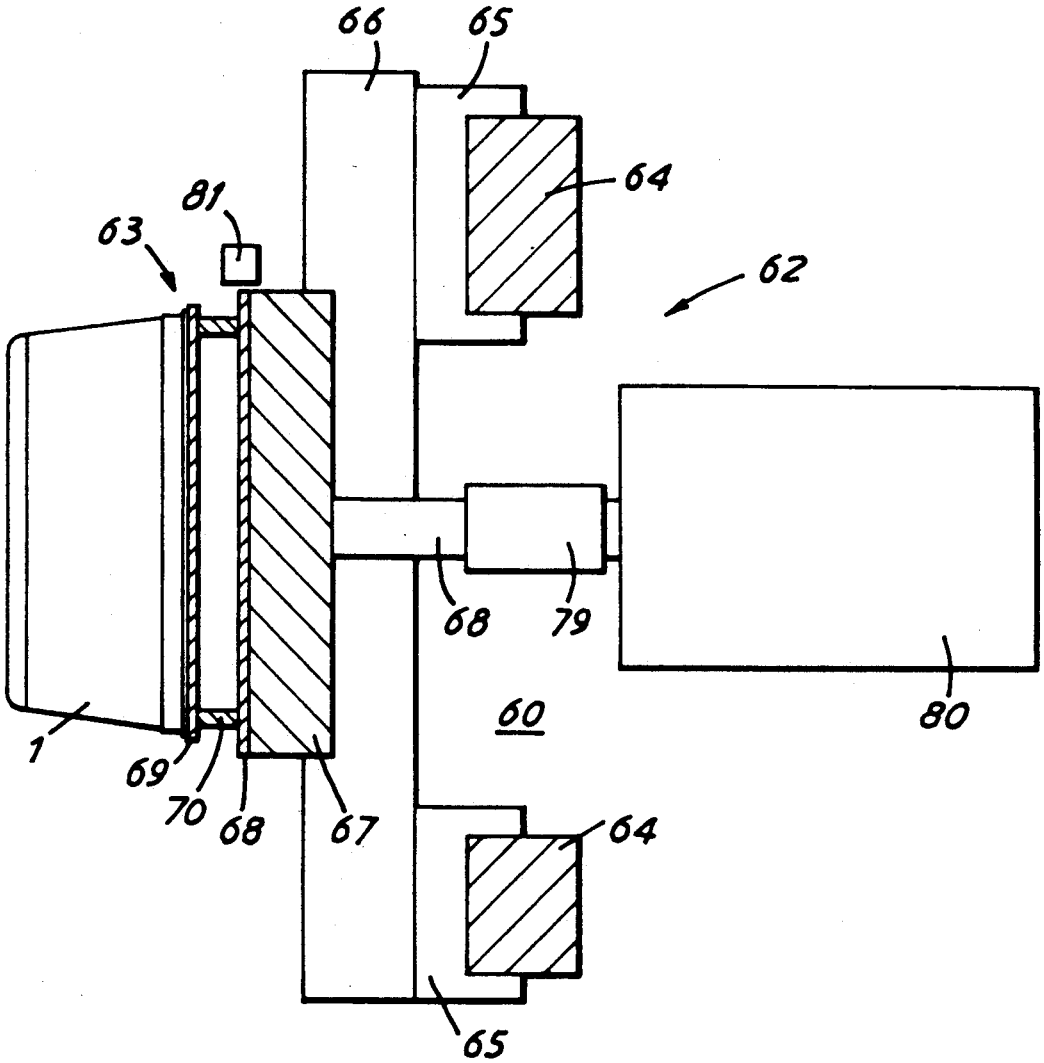
FIG. 8 is a cross-sectional view taken on the line 8—8 of FIG. 7.

Referring now to FIGS. 7 and 8, there are shown plan and cross-sectional views of an assembly 60 and a printing head 61 forming part of the second printing apparatus. The assembly 61 comprises a handling mechanism 62 and a carrier 63.

The handling mechanism 62 includes a support structure in the form of a pair of parallel rails 64. A first slide member comprising a carriage 66 and a pair of guides 65 is mounted on rails 64 for sliding movement along a first axis. A second slide member 67 is mounted on carriage 66 for sliding movement along a second axis which is perpendicular to the first axis.

The carrier 63 is mounted on one end of a shaft 68 which is itself rotatably mounted on the second slide member 67. Thus, the carrier 63 is mounted for rotation about a third axis which is perpendicular to both the first and second axes. The carrier 63 comprises a base plate 68 and a support plate 69 connected together by a collar 70. A container 1 is shown located on carrier 63. Although not shown, the container 1 is held in position by four locking bars provided on support plate 69.

In order to drive the carriage 66 along the first axis, there is provided a drive screw 71 which extends generally above one of the rails 64 and which is in threaded engagement with carriage 66. One end of screw 71 is received in a bearing 72 provided at one end of rail 64. The other end of screw 71 is connected to the output shaft of a motor 73.

Similarly, in order to drive the second slide member 67 along the second axis, there is provided a drive screw 75 which extends generally above carriage 66 and which is in threaded engagement with the second sliding member 67. One end of screw 75 is received in a bearing 76 provided at one end of carriage 66. The other end of screw 75 is connected to the output shaft of a motor 77.

Alternatively, in place of the drive screws 71 and 75 and motors 73 and 77, the carriage 66 and slide member 67 may be driven by a pair of linear motors.

In order to rotate the carrier 63 about the third axis, the shaft 68 is connected by a coupling 79 to the output shaft of a motor 80.

The printing head 61 is identical to the printing head 10 of FIG. 3. The printing head 10 is located so as to print patterns on the side wall of container 1.

The assembly 60 also includes position sensor 81 located adjacent the periphery of base plate 68 of carrier 63. The position sensor 81 detects the passage of position markers provided on base plate 68.

Figure 9:
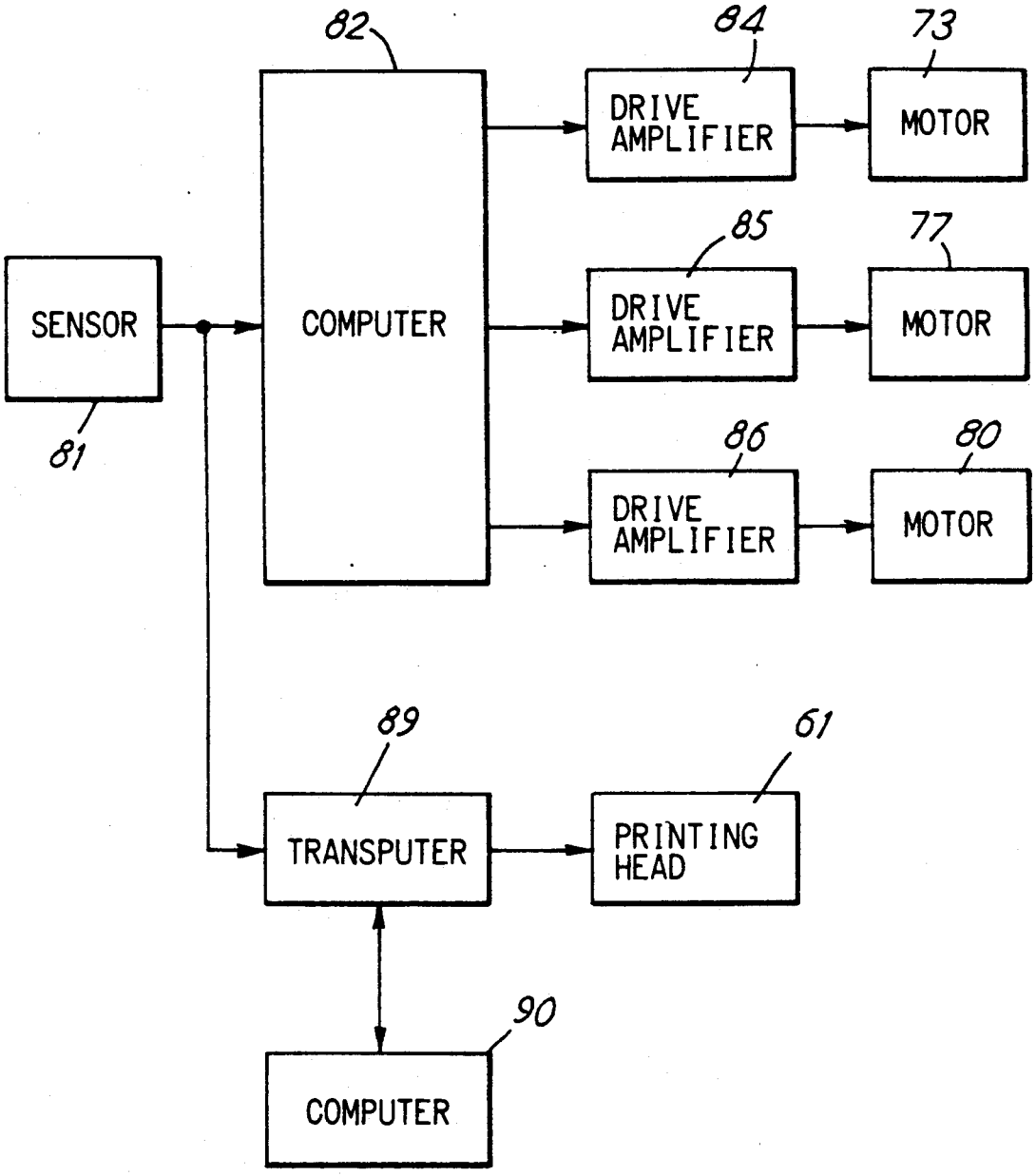
FIG. 9 is a block diagram of the control system for the assembly of FIG. 7.

Referring now to FIG. 9, there is shown a block diagram of the control system for assembly 60 and printing head 61. In the control system, the output of sensor 81 is connected to the input of a computer 82 and to the input of a transputer 89. Three outputs of computer 82 are connected respectively to the input of three drive amplifiers 84, 85, 86. The power outputs of the drive amplifiers 84, 85, 86 are connected to the inputs of three motors 73, 77, 80. The transputer 89 controls the printing head 61 and a computer 90 programs transputer 89.

In operation, the computer 82 uses the output of sensor 81 to calculate the position of carrier 63 and hence container 1. The computer 82 operates the three motors 74, 77, 80 so that the entire circumference of the side wall of container 1 passes in front of printing head 61 with a small but constant clearance being maintained therebetween. Such movement is possible because the carrier 63 can be displaced along two mutually perpendicular axes and rotated about a third axis. The transputer 89 operates the printing head 61 so as to print a pattern in a desired position.

In order to change the patterns, it is only necessary to make the computer 90 change the pattern in transputer 89. In order to adapt the assembly 60 for use with a different shape of container, it is only necessary to change the carrier and to make a change in the program of the computer 82 so that the carrier is moved in a manner appropriate to the shape of the new container.

In a manner similar to that described with reference to FIGS. 5 and 6, the second printing apparatus comprises six assemblies identical to assembly 60 and mounted at spaced apart positions on an indexing table. Spaced around the indexing table, there are provided a loading station, four printing heads, and an unloading station.

Alternatively, the printing heads may be arranged in a line and the assemblies conveyed to each printing head in turn by a linear conveyor.

Where it is desired to print a pattern in one colour only, this may be achieved with a single assembly 60 and a single printing head 61 and without an indexing table or other conveyor.

Although the present invention has been described with reference to inkjet printing heads, it is suitable for use with other types of non-contact printing head.

I claim:

1. An apparatus for printing a pattern on a container component having an endless wall, said endless wall having a non-circular profile, said apparatus comprising a non-contact printing head which remains stationary during printing, a carrier for supporting a container, a handling mechanism for moving the carrier so that at least a curvilinear portion of said endless wall passes in front of the printing head while maintaining a substantially constant clearance between the printing head and said endless wall, means for operating the printing head so as to cause a desired pattern to be printed on said endless wall, said carrier including an endless wall part having a profile matching that of said endless wall of the container component and a support part for supporting the container component, the handling mechanism comprises a pair of rollers mounted to form a nip therebetween, and means for rotating at least one of said rollers, the wall part of the carrier being held, in use, in said nip.

2. An apparatus as claimed in claim 1 further comprising detecting means for detecting the position of the carrier relative to the printing head, the operating means for the printing head being responsive to the output of the detecting means, whereby the pattern may be printed on said endless wall of the container at a desired position.

3. An apparatus as claimed in claim 1 comprising a set of non-contact printing heads located at spaced apart positions, a set of assemblies each of which comprises a carrier for a container and an associated handling mechanism for the carrier, a station for loading containers onto the carriers, a station for unloading containers from the carriers, and a conveyor for conveying the assemblies, in series and in a cyclic manner, to the loading station, then to each printing head in turn, then to the unloading station and then back to the loading station.

4. An apparatus as claimed in claim 3, in which the conveyor comprises an indexing table, said assemblies being mounted on the indexing table at spaced apart positions.

5. An apparatus as claimed in claim 1 in which the or each printing head comprises an inkjet printing head.

6. An apparatus for printing a pattern on a container component having an endless wall, said apparatus comprising a non-contact printing head which remains stationary during printing, a carrier for supporting a container, a handling mechanism for moving the container, and means for operating the printing head so as to cause a desired pattern to be printed on said endless wall, in which the carrier comprises an endless wall part having a profile matching that of said endless wall of the container component and a support part for supporting the container component, and the handling mechanism comprises a pair of rollers mounted to form a nip therebetween and means for rotating at least one of said rollers, the wall part of the carrier being held, in use, in said nip.

7. An apparatus as claimed in claim 6, in which the printing head comprises an inkjet printing head.

8. A method of printing a pattern on a container component having an endless wall with a non-contact printing head, said endless wall having a non-circular profile, said method comprising the steps of: supporting a container component on a carrier, moving the carrier so that at least a curvilinear portion of said endless wall passes in front of the printing head while maintaining a substantially constant clearance between the printing head and said endless wall, operating the printing head so as to cause a desired pattern to be printed on said endless wall, the carrier includes an endless wall part having a profile matching that of said endless wall of the container and a support part for supporting the container, and the handling mechanism comprises a pair of rollers mounted to form a nip therebetween, said method comprising the additional steps of holding the wall part of the carrier in the nip between the rollers and rotating at least one of the rollers.

9. A method as claimed in claim 8, comprising the additional steps of detecting the position of the carrier relative to the printing head, and operating the printing head so as to cause the pattern to be printed on said endless wall of the container at a desired position.

10. A method as claimed in claim 8, comprising the additional steps of detecting the position of the carrier relative to the printing head, and operating the printing head so as to cause the pattern to be printed on said endless wall of the container at a desired position.

11. A method of printing a pattern on a container component having an endless wall with a non-contact printing head, said method comprising the steps of: supporting a container component on a carrier, the carrier having an endless wall part having a profile matching that of said endless wall of the container component and a support part for supporting the container, holding the wall part of the carrier in a nip between a pair of rollers, rotating at least one of the rollers so as to cause at least a portion of said endless wall of the container component to pass in front of the printing head with a clearance between the printing head and said endless wall, and operating the printing head so as to cause a desired pattern to be printed on said endless wall.

* * * * *